US008622317B1

(12) United States Patent
Anuskiewicz

(10) Patent No.: US 8,622,317 B1
(45) Date of Patent: Jan. 7, 2014

(54) IRRIGATION SPRINKLER WITH TWIST-AND-LOCK DEBRIS SCREEN

(75) Inventor: Ronald H. Anuskiewicz, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 227 days.

(21) Appl. No.: 13/168,822

(22) Filed: Jun. 24, 2011

(51) Int. Cl.
*B05B 15/10* (2006.01)

(52) U.S. Cl.
USPC ..... 239/205; 239/590

(58) Field of Classification Search
USPC ..... 239/200–206, 590, 590.3
See application file for complete search history.

(56) References Cited

U.S. PATENT DOCUMENTS

| | | | | | |
|---|---|---|---|---|---|
| 4,202,499 | A | * | 5/1980 | Mathews | 239/206 |
| 5,174,501 | A | * | 12/1992 | Hadar | 239/205 |
| 5,423,486 | A | | 6/1995 | Hunter | 239/205 |
| 5,785,248 | A | | 7/1998 | Staylor et al. | 239/237 |
| 6,491,235 | B1 | | 12/2002 | Scott et al. | 239/206 |
| 6,799,732 | B2 | | 10/2004 | Sirkin | 239/205 |
| 6,848,632 | B2 | | 2/2005 | Clark | 239/203 |
| 7,303,147 | B1 | | 12/2007 | Danner et al. | 239/203 |
| 7,677,469 | B1 | | 3/2010 | Clark | 239/242 |
| 7,861,948 | B1 | | 1/2011 | Crooks et al. | 239/237 |
| 2008/0308650 | A1 | | 12/2008 | Clark | 239/204 |

* cited by examiner

*Primary Examiner* — Christopher Kim
(74) *Attorney, Agent, or Firm* — Knobbe, Martens, Olson & Bear LLP

(57) ABSTRACT

An irrigation sprinkler has a generally tubular riser assembly including a nozzle turret rotatably mounted at an upper end of the riser assembly and a drive assembly coupled for rotating the nozzle turret. The riser assembly has at least one locking recess formed in a lower end of the riser assembly. A debris screen is removably mounted to a lower end of the riser assembly. The debris screen is formed with a plurality of apertures for filtering debris from water flowing through the apertures. The debris screen is dimensioned and configured to mate with the lower end of the riser assembly. The debris screen has at least one lock that is dimensioned and configured to be received in the locking recess for holding the debris screen to the riser assembly. In an alternate embodiment, the lock can be located on the lower end of the riser assembly and the recess can be located on the screen.

20 Claims, 6 Drawing Sheets

IRRIGATION SPRINKLER WITH TWIST-AND-LOCK DEBRIS SCREEN

FIELD OF THE INVENTION

The present invention relates to sprinklers used to irrigate turf and landscaping.

BACKGROUND OF THE INVENTION

Many areas of the world have insufficient rainfall during parts of the year to maintain healthy turf and landscaping. Sprinkler systems are therefore widely used in commercial and residential irrigation that include an electronic irrigation controller that executes a watering program. The irrigation controller turns solenoid actuated valves ON and OFF in accordance with the watering program. The valves deliver water through buried pipes to sprinklers located in various zones of the irrigation site. The sprinklers are typically rotor-type sprinklers, rotary stream sprinklers or spray-type sprinklers. Usually the sprinklers include a molded plastic screen to filter sand, grit and other debris from the water to prevent the same from clogging the orifices in the nozzle. Sometimes the screen needs to be removed from the sprinkler and replaced, such as when it becomes clogged. The screen can be cleaned and re-installed if it has not been damaged. The screen can otherwise be replaced with a new screen. Rotor-type sprinklers have heretofore not included debris screens that are easily removed and replaced. Typically in a rotor-type sprinkler one end of the screen is press fit against the inside of a shoulder formed at the lower end of the tubular riser assembly. The user must be grip the screen with pliers and pull out the press fit end of the sprinkler. Alternatively, the user must pry out the press fit end with a screw driver. Both operations are tedious and the user risks damaging the screen. Removal of the screen by prying with a screwdriver or other pointed tool subjects a person to a risk of injuring fingers or the palm of a hand.

SUMMARY OF THE INVENTION

In accordance with the present invention an irrigation sprinkler has a generally tubular riser assembly including a nozzle turret rotatably mounted at an upper end of the riser assembly and a drive assembly coupled for rotating the nozzle turret. The sprinkler further has a generally cylindrical debris screen formed with a plurality of apertures for filtering debris from water flowing through the apertures. The debris screen is dimensioned and configured to mate with a lower end of the riser assembly. The sprinkler further includes at least one locking mechanism having a first portion on the lower end of the riser assembly and a second portion on the screen. The first and second portions of the locking mechanism are located so that they can be mated when the debris screen is mated with the lower end of the riser. The first and second portions of the locking mechanism are configured so that they can be positively locked and unlocked by a combination of relative axial and rotational motion between the debris screen and the riser assembly. The locking mechanism holds the debris screen to the riser assembly when locked.

DETAILED DESCRIPTION

The embodiment of the present invention described hereafter is particularly useful in large rotor-type sprinklers used on golf courses. One such sprinkler is disclosed in U.S. Pat. No. 7,677,469 of Michael L. Clark granted Mar. 16, 2010 and entitled "Sprinkler with Reversing Planetary Gear Drive", the entire disclosure of which is hereby incorporated by reference. Said patent is assigned to Hunter Industries, Inc., the assignee of the present application. See also U.S. Pat. No. 6,491,235 of Loren W. Scott et al. granted Dec. 10, 2002 and entitled "Pop-Up Sprinkler with Top Serviceable Diaphragm Valve Module", also assigned to Hunter Industries, Inc., the entire disclosure of which is also hereby incorporated by reference.

Figure 1:
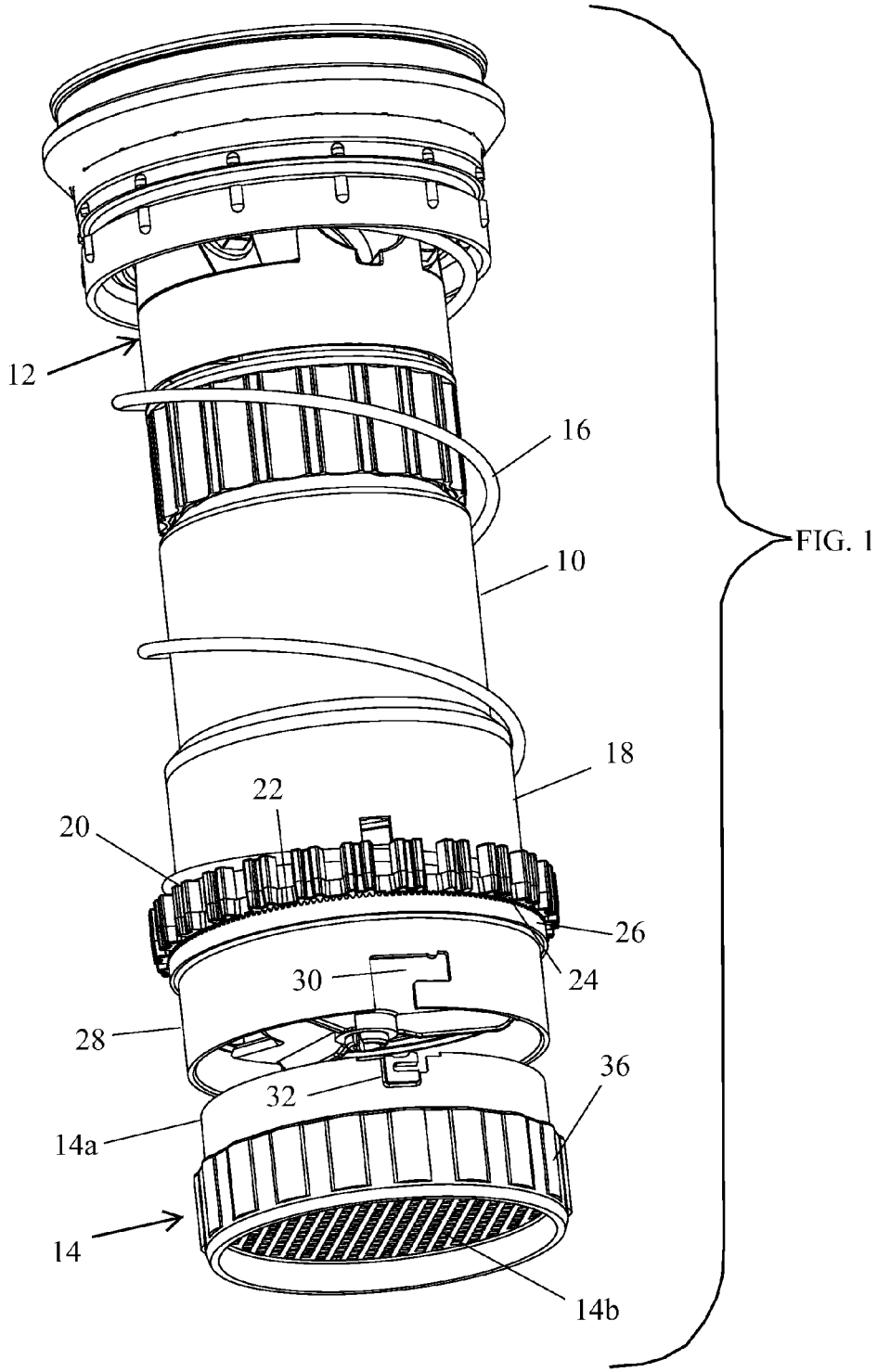
FIG. 1 is a partially exploded isometric view of a sprinkler with a twist-and-lock debris screen in accordance with an embodiment of the present invention.

Unless otherwise indicated, the parts of the embodiment described and illustrated herein are made of injection molded plastic. Shafts and springs used in the illustrated embodiment are preferably made of steel or other suitable metal. Referring to FIG. 1 a generally tubular riser assembly 10 includes a nozzle turret 12 mounted at its upper end and a generally cylindrical debris screen 14 removably mounted at its lower end. While not illustrated in FIG. 1, a drive assembly including a turbine, gear train reduction, and an optional reversing mechanism are mounted inside the riser assembly 10. The sprinkler that uses the present invention may be constructed to oscillate the nozzle turret 12 between pre-set arc limits or it may be constructed to rotate continuously through three hundred and sixty degrees. The sprinkler may also be constructed so that it can be optionally set to operate in a part-circle mode or in a full circle mode. Therefore, the drive assembly need not include a reversing mechanism.

A stainless steel coil spring 16 (FIG. 1) surrounds the riser assembly 10 and its opposite ends engage the nozzle turret 12 and an alignment sleeve 18 loosely surrounding the lower portion of the riser assembly 10. The alignment sleeve 18 has a plurality of circumferentially spaced, vertically extending guide fingers 20 that fit between ribs molded on an interior surface of an outer case (not illustrated) of the sprinkler. The lower end of the alignment sleeve 18 is formed with saw-shaped teeth 22 that engage similar teeth 24 on a shoulder 26 (FIGS. 1 and 5) formed on the lower portion of the riser assembly 10. The coil spring 16 is compressed when the sprinkler is pressurized with water and the riser assembly 10 extends from the outer case. When the water is not turned ON, the riser assembly 10 can be manually raised by lifting the riser assembly 10 above the outer case using a tool. The riser assembly 10 can be rotated manually to disengage the teeth 24 on the shoulder 26 from the teeth 22 on the alignment sleeve 18. This allows the riser assembly 10 to be manually rotated within the outer case to set one of the arc limits of rotation of the nozzle turret 12. In some cases, depending on the water pressure and/or the size of the sprinkler, the riser can be rotated manually by hand when the water is on. The case is normally buried in the soil and the riser assembly 10 extends telescopically when the water is turned ON so that adjacent turf can be irrigated. The riser assembly 10 can serve as a sprinkler without being telescopically mounted in an outer case. When used in this configuration the lower end of the riser assembly 10 is coupled to a fixed riser (not illustrated) and permanently extends above the ground for watering adjacent shrubs and hillsides.

The debris screen 14 has a generally cylindrical flange 14*a* (FIG. 1) and is dimensioned to fit loosely within a cylindrical wall 28 forming the lower end of the riser assembly 10. A locking recess 30 is formed in the cylindrical wall 28 of the riser assembly 10. A lock 32 projects radially outwardly from the cylindrical flange 14*a*. The locking recess 30 has a generally L-shaped configuration with a first leg 30*a* (FIG. 5) that extends in a vertical direction generally parallel to a vertical central axis of the riser assembly 10. The locking recess 30 has a second leg 30*b* that extends in a circumferential direction generally perpendicular to the vertical axis of the riser assembly 10. An edge 33 of the cylindrical wall 28 that defines the upper edge of the second leg 30*b* of the locking recess 30 is formed with a rounded fixed tab 34. The lock 32 is formed with a similarly rounded flexible tab 32*a* that can flex in an axially downward direct to move past the fixed tab 34 upon counter-clockwise rotation (viewed from above the top of the riser assembly 10) of the cylindrical flange 14*a* of the debris screen 14 within the cylindrical wall 28 of the riser assembly 10. The flexible tab 32 is spring-like and flexes back in an axially upward direction behind the fixed tab 34 to hold the debris screen 14 to the riser assembly 10.

Figure 5:
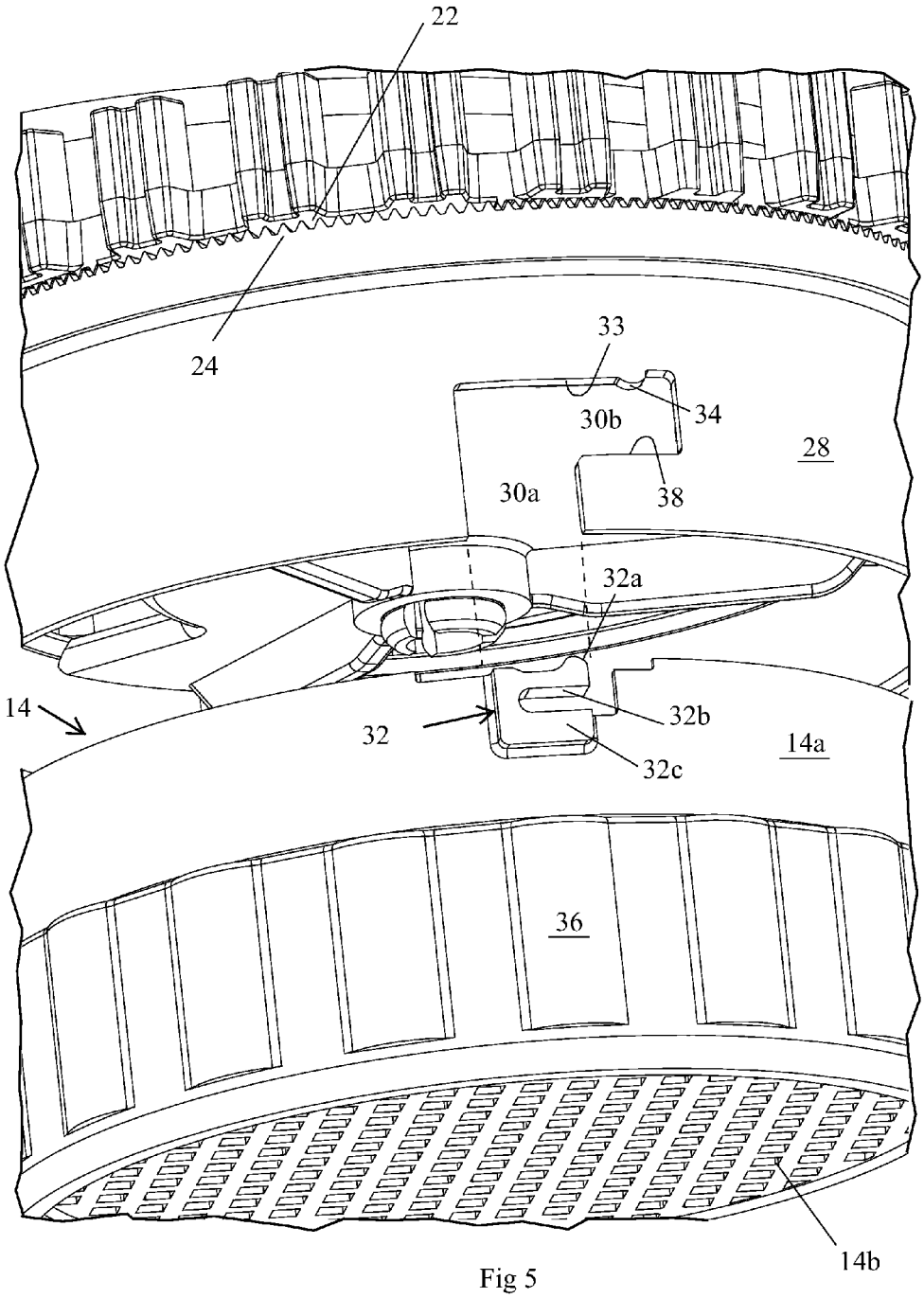
FIG. 5 is a greatly enlarged portion of FIG. 1 illustrating details of the flexible locking tab and the locking recess of the illustrated embodiment.
Figure 7:
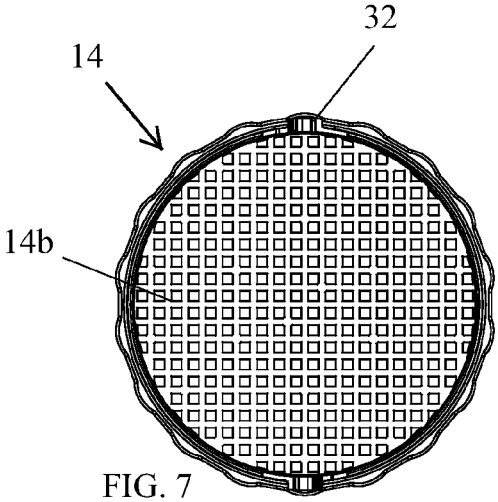
FIG. 7 is a top plan view of the debris screen illustrated in FIG. 6.
Figure 9:
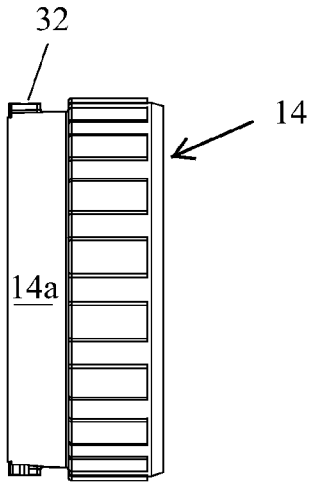
FIG. 9 is a right side elevation view of the debris screen illustrated in FIG. 6 taken from the right side of FIG. 7. The left side elevation view of the debris screen (not shown) is identical to FIG. 9.
Figure 10:
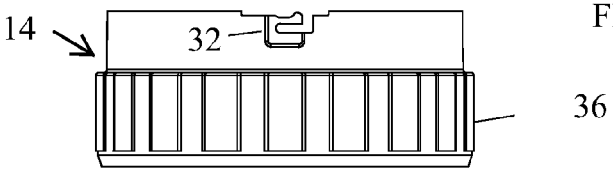
FIG. 10 is front elevation view of the debris screen illustrated in FIG. 6. The rear elevation view of the debris screen (not shown) is identical to FIG. 10.
Figure 8:
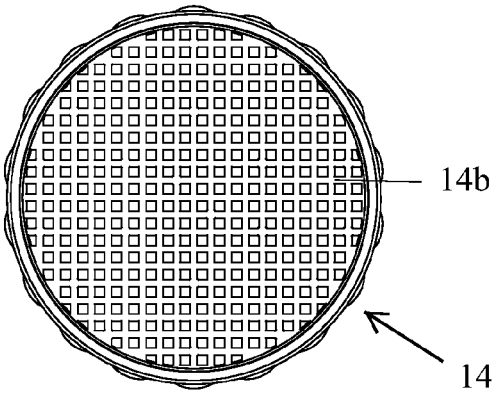
FIG. 8 is a bottom plan view of the debris screen illustrated in FIG. 6.
Figure 6:
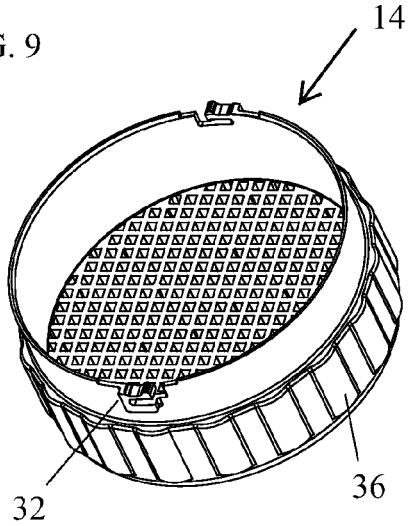
FIG. 6 is an isometric view of the debris screen of the sprinkler of FIG. 1 taken from above.

Referring still to FIG. 5, the lock 32 is formed as a generally U-shaped member with a pair of legs 32*b* and 32*c*, the flexible tab 32*a* is formed on the remote end of the leg 32*b*. The leg 32*c* is formed on the outer surface of the cylindrical flange 14*a* of the debris screen 14. The debris screen 14 includes a generally disc-shaped perforated portion 14*b* (FIG. 1) formed with a plurality of apertures. The disc-shaped portion is generally planar and is surrounded by the cylindrical flange 14*a*. The perforated portion 14*b* of the debris screen 14 is made of interconnected rows and columns of molded plastic that define the plurality of apertures. The apertures have a generally rectangular shape and preferably have a maximum dimension of about 0.080 inches. The riser assembly 10 is designed for use in relatively large rotor-type sprinklers used on golf courses. Such sprinklers are relatively dirt resistant and the debris screen 14 is designed to filter large chucks of debris such as small pieces of stone and algae. These are often encountered by sprinklers used to irrigate gold courses since the water is frequently pumped from wells and ponds. The lower portion of the cylindrical flange 14*a* has an enlarged diameter and is formed with a plurality of circumferentially spaced axially extending ribs 36 to facilitate manual gripping and rotation of the debris screen 14 relative to the riser assembly 10.

Figure 2:
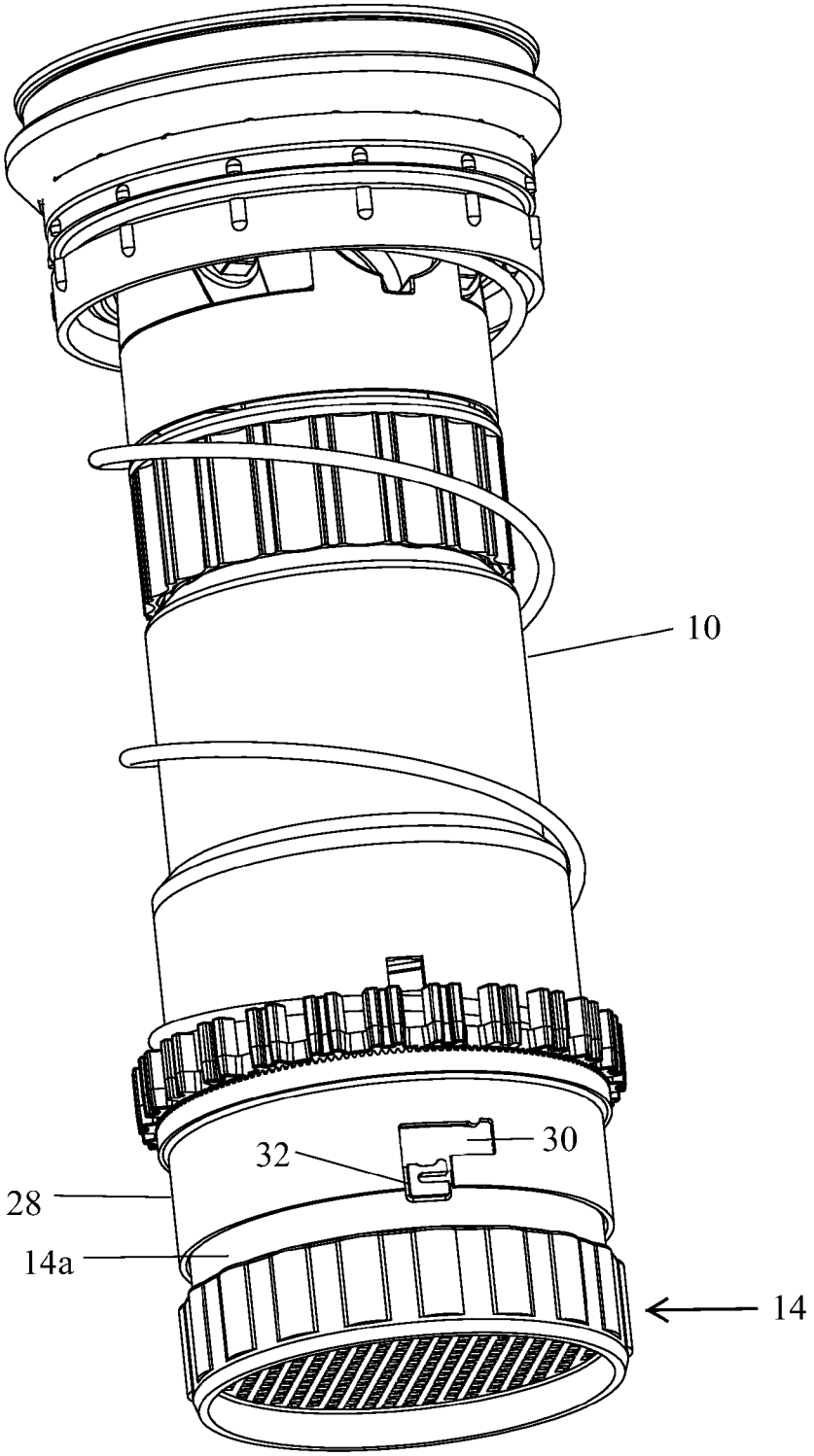
FIGS. 2-4 are views similar to FIG. 1 sequentially illustrating the installation and locking of the debris screen on the lower end of the riser assembly.
Figure 3:
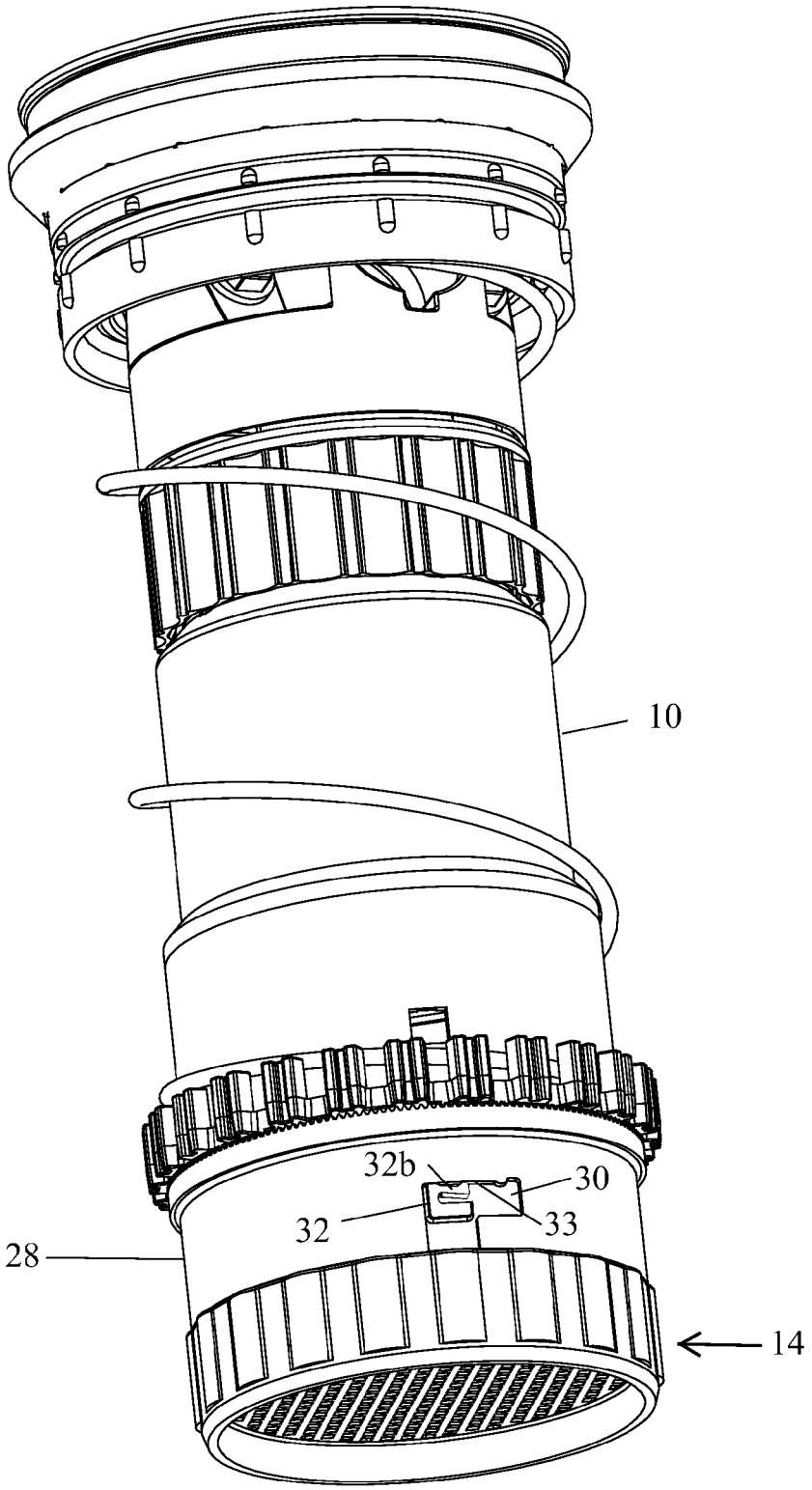
Figure 4:
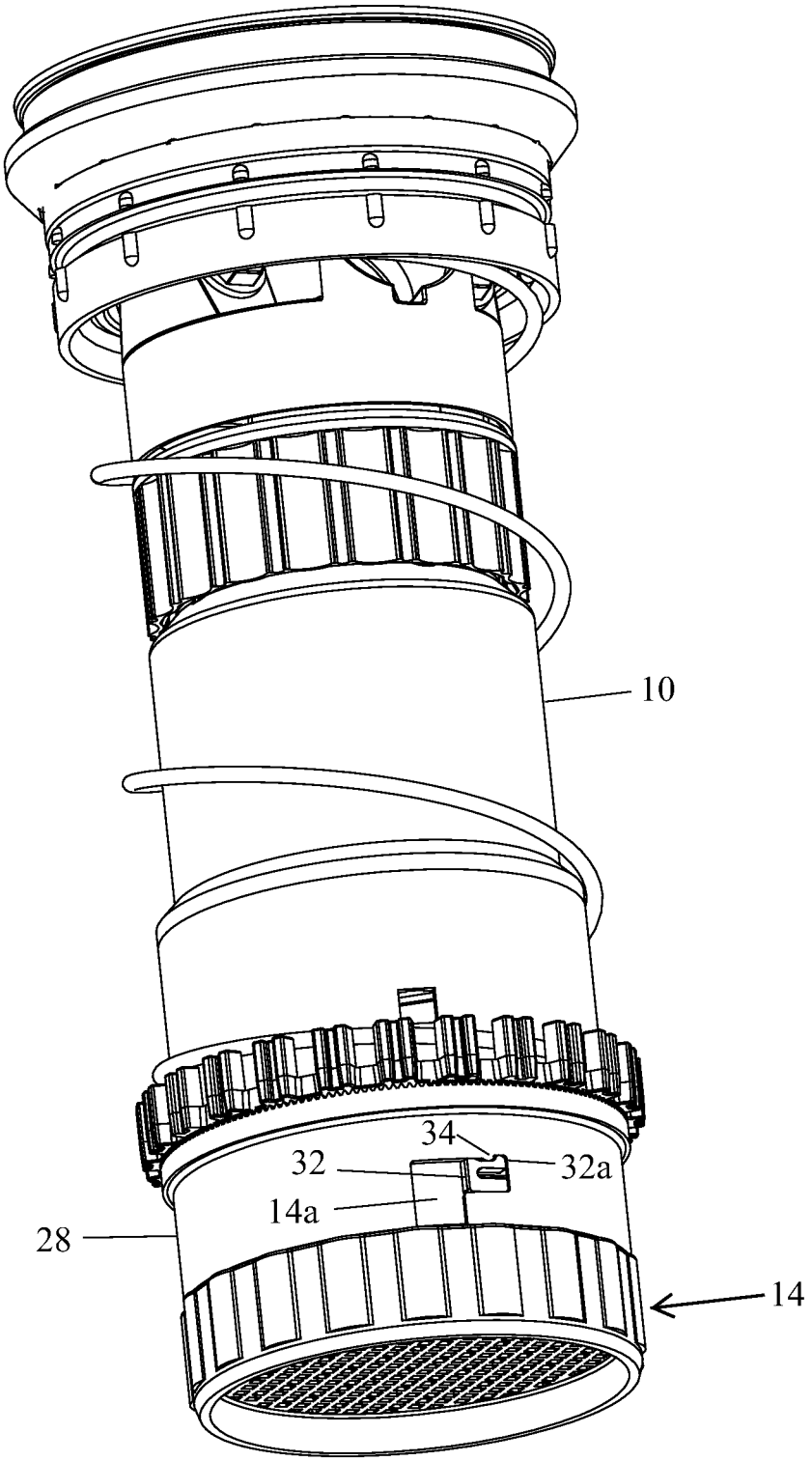

Referring to FIGS. 2-4, the debris screen 14 can be vertically slid into the lower end of the riser assembly 10, and then twisted about the vertical axis of the riser assembly 10 so that the lock 32 slides laterally in the recess 30 and snaps into place behind the fixed tab 34 to lock the debris screen 14 to the riser assembly 10. Counter-clockwise twisting of the debris screen 14 relative to the riser assembly 10 (viewed from above the riser assembly 10) from the position illustrated in FIG. 3 to the position illustrated in FIG. 4 places the lock 32 above an edge 38 (FIG. 5) of the cylindrical wall 28 of the riser assembly 10 that defines the lower edge of the second leg 30*b* of the recess 30. This prevents accidental de-coupling of the debris screen 14 from the riser assembly 10 if only axially downward forces are exerted on the debris screen 14 relative to the riser assembly 10. The embodiment illustrated in FIGS. 1-5 thus provides a reliable twist-and-lock attachment mechanism that allows for quick removal and replacement of the debris screen 14 from the lower end of the riser assembly. The removal process entails the steps illustrated in reversing the order of FIGS. 2-4 in which the screen is first twisted in a clockwise direction (viewed from above the riser assembly 10) and then pulled downwardly. The highly beneficial result of the present invention is that a clogged and/or damaged screen on rotor-type irrigation sprinkler can be more quickly, easily and safely removed and replaced by service personnel.

FIGS. 6-10 illustrate the ornamental design of the debris screen 14. The debris screen 14 can be injection molded out of suitable plastic in a wide variety of configurations depending on the design of the sprinkler and its particular filtering needs.

While a preferred embodiment of the present invention has been described in detail, variations and adaptations thereof will occur to those skilled in the art. For example, the pattern and size of apertures in the debris screen 14 can be varied to meet the particular needs of the size and type of irrigation sprinkler. The lock 32 could be positioned on the lower end of the riser assembly 10 and the locking recess 30 could be formed on the cylindrical flange 14*a*. The locking recess 30 need not extend radially all the way through the cylindrical wall 28 or the cylindrical flange 14*a* but could instead be a groove or channel. The lock 32 could take various other forms such as a bayonet lock or any type of projection that engages a suitable detent or latch. Preferably there are two locks and two locking recesses at spaced one hundred and eighty degrees apart on the circumference of the debris screen 14 although a single lock and recess could be used or the riser assembly 10 and the debris screen 14 could be locked together at more than two locations. Thus the present invention broadly includes a locking mechanism having a first portion on the lower end of the riser assembly and a second portion on a generally cylindrical debris screen that can be mated and positively locked and unlocked by relative axial and rotational motion between the debris screen and the riser assembly. Therefore, the protection afforded the present invention should only be limited in accordance with the following claims.

What is claimed is:

1. An irrigation sprinkler, comprising:

a generally tubular riser assembly including a nozzle turret rotatably mounted at an upper end of the riser assembly and a drive assembly coupled for rotating the nozzle turret;

a generally cylindrical debris screen formed with a plurality of apertures for filtering debris from water flowing through the apertures, the debris screen being dimensioned and configured to mate with a lower end of the riser assembly; and at least one locking mechanism having a first portion on the lower end of the riser assembly and a second portion on the debris screen, the first and second portions of the locking mechanism being located so that they can be mated when the debris screen is mated with the lower end of the riser assembly, and the first and second portions of the locking mechanism being configured so that they can be positively aligned with a relative axial motion between the debris screen and the riser assembly, and further locked and unlocked by rotational motion between the debris screen and the riser assembly, the locking mechanism holding the debris screen to the riser assembly when locked;

wherein the first portion of the locking mechanism is a locking recess, and wherein the locking recess has a generally L-shaped configuration with a first leg that extends in a direction generally parallel to a vertical axis of the riser assembly and a second leg that extends in a direction generally perpendicular to the vertical axis of the riser assembly.

2. The sprinkler of claim 1 wherein the second portion of the locking mechanism is a lock that slides within the locking recess.

3. The sprinkler of claim 2 wherein the lock is a generally V-shaped member with a pair of legs, one leg of the legs providing a flexible arm with a flexible locking tab.

4. The sprinkler of claim 1 wherein the locking recess is formed in a cylindrical wall at the lower end of the riser assembly.

5. The sprinkler of claim 4 wherein the lock is formed on a cylindrical flange of the screen.

6. The sprinkler of claim 5 wherein the debris screen includes a generally disc-shaped portion formed with a plurality of apertures that is surrounded by the cylindrical flange.

7. The sprinkler of claim 1 wherein the second leg of the locking recess is formed with a fixed tab and the lock is formed with a flexible tab that can flex in a first axial direction to move past the fixed tab upon rotation of the cylindrical flange of the debris screen within the cylindrical wall of the riser assembly and flex in a second axial direction to hold the debris screen to the riser assembly.

8. The sprinkler of claim 7 wherein the flexible tab is formed on one end of a flexible arm.

9. The sprinkler of claim 1 wherein the second leg of the locking recess includes a locking cavity, the lock includes a flexible tab, and at least a portion of the flexible tab is configured to releasably engage with the locking cavity to hold the debris screen to the riser assembly.

10. An irrigation sprinkler, comprising:

a generally tubular riser assembly including a nozzle turret rotatably mounted at an upper end of the riser assembly and a drive assembly coupled for rotating the nozzle turret, the riser assembly having at least one locking recess formed in a lower end of the riser assembly;

a debris screen formed with a plurality of apertures for filtering debris from water flowing through the apertures, the debris screen being dimensioned and configured to mate with the lower end of the riser assembly; and at least one lock on the debris screen that is dimensioned and configured to be received in the locking recess via relative axial motion between the debris screen and the riser assembly and configured to lock and unlock with the locking recess via relative rotational motion between the debris screen and the riser assembly to hold the debris screen to the riser assembly;

wherein the lock is a generally U-shaped member with a pair of legs, one leg of the legs providing a flexible arm with a flexible locking tab.

11. The sprinkler of claim 10 wherein the debris screen has a generally cylindrical flange dimensioned to mate within a cylindrical wall forming the lower end of the riser assembly, the locking recess is formed in the cylindrical wall of the riser assembly and the lock projects radially outwardly from the cylindrical flange.

12. The sprinkler of claim 11 wherein the locking recess has a generally L-shaped configuration with a first leg that extends in a direction generally parallel to a vertical axis of the riser assembly and a second leg that extends in a direction generally perpendicular to the vertical axis of the riser assembly.

13. The sprinkler of claim 12 wherein the second leg of the locking recess is formed with a fixed tab and the lock is formed with a flexible tab that can flex in a first axial direction to move past the fixed tab upon rotation of the cylindrical flange of the debris screen within the cylindrical wall of the riser assembly and flex in a second axial direction to hold the debris screen to the riser assembly.

14. The sprinkler of claim 13 wherein the flexible tab is formed on one end of a flexible arm.

15. The sprinkler of claim 12 wherein the second leg of the locking recess includes a locking cavity and at least a portion of the flexible locking tab is configured to releasably engage with the locking cavity to hold the debris screen to the riser assembly.

16. The sprinkler of claim 12, wherein the pair of legs extend from a base of the U-shaped member, and wherein the base of the U-shaped member has a height that is substantially the same as a height of the second leg in the direction generally perpendicular to the vertical axis of the riser assembly.

17. The sprinkler of claim 11 wherein the debris screen includes a generally disc-shaped portion formed with a plurality of apertures that is surrounded by the cylindrical flange.

18. The sprinkler of claim 17 wherein a perforated portion of the debris screen is made of interconnected rows and columns of molded plastic that define the plurality of apertures.

19. The sprinkler of claim 11 wherein an outer surface of the cylindrical flange of the disc-shaped portion of the debris screen is formed with a plurality of circumferentially spaced axially extending ribs to facilitate manual gripping and rotation of the debris screen relative to the riser assembly.

20. An irrigation sprinkler, comprising:

a generally tubular riser assembly including a nozzle turret rotatably mounted at an upper end of the riser assembly and a drive assembly coupled for rotating the nozzle turret, the riser assembly having at least one locking recess formed in a cylindrical wall at a lower end of the riser assembly;

a debris screen formed with a plurality of apertures for filtering debris from water flowing through the apertures, the debris screen being dimensioned and configured to mate with the lower end of the riser assembly; and at least one lock on the debris screen that is dimensioned and configured to be received in the locking recess for holding the debris screen to the riser assembly; and wherein the debris screen has a generally cylindrical flange dimensioned to mate within the cylindrical wall at the lower end of the riser assembly, the locking recess is formed in the cylindrical wall of the riser assembly and the lock projects radially outwardly from the cylindrical flange, and further, wherein the locking recess has a generally L-shaped configuration with a first leg that extends in a direction generally parallel to a vertical axis of the riser assembly and a second leg that extends in a direction generally perpendicular to the vertical axis of the riser assembly, and further wherein the second leg of the locking recess is formed with a fixed tab and the lock is formed with a flexible tab that can flex in a first axial direction to move past the fixed tab upon rotation of the cylindrical flange of the debris screen within the cylindrical wall of the riser assembly and flex in a second axial direction to hold the debris screen to the riser assembly.

* * * * *

UNITED STATES PATENT AND TRADEMARK OFFICE

CERTIFICATE OF CORRECTION

PATENT NO. : 8,622,317 B1
APPLICATION NO. : 13/168822
DATED : January 7, 2014
INVENTOR(S) : Ronald H. Anuskiewicz It is certified that error appears in the above-identified patent and that said Letters Patent is hereby corrected as shown below:

In the Claims

In column 5 at line 20, In Claim 3, change "V-shaped" to --U-shaped--.

Signed and Sealed this
Thirty-first Day of March, 2015

Michelle K. Lee

Michelle K. Lee
*Director of the United States Patent and Trademark Office*